United States Patent [19]

Reinert et al.

[11] Patent Number: 4,964,871

[45] Date of Patent: Oct. 23, 1990

[54] PROCESS FOR PREVENTING YELLOWING OF POLYAMIDE FIBRE MATERIALS TREATED WITH STAIN-BLOCKING AGENTS BY TREATMENT WITH WATER-SOLUBLE LIGHT STABILIZER HAVING FIBRE AFFINITY

[75] Inventors: Gerhard Reinert, Allschwil; Jörg Binz, Reinach, both of Switzerland

[73] Assignee: Ciba-Geigy Corporation, Ardsley, N.Y.

[21] Appl. No.: 342,926

[22] Filed: Apr. 25, 1989

[30] Foreign Application Priority Data

May 4, 1988 [CH] Switzerland ..... 1666/88-0

[51] Int. Cl.[5] ..... D06M 13/34; D06M 15/41; D06M 3/30; D06P 5/06

[52] U.S. Cl. ..... 8/115.59; 8/115.51; 8/115.58; 8/490; 8/566; 8/567; 8/573; 8/924; 252/8.6

[58] Field of Search ..... 8/115.58, 115.59, 490

[56] References Cited

U.S. PATENT DOCUMENTS

| | | | |
|---|---|---|---|
| 4,592,940 | 6/1986 | Blyth et al. | 252/8.7 |
| 4,668,235 | 5/1987 | Evans et al. | 8/115.58 |
| 4,698,064 | 10/1987 | Evans et al. | 8/128.3 |
| 4,770,667 | 9/1988 | Evans et al. | 8/128.1 |
| 4,780,099 | 10/1988 | Greschler et al. | 8/115.6 |
| 4,784,665 | 11/1988 | Ona et al. | 8/115.6 |
| 4,874,391 | 10/1989 | Reinert | 8/442 |
| 4,877,538 | 10/1989 | Kirjanov et al. | 252/8.7 |

FOREIGN PATENT DOCUMENTS

| | | |
|---|---|---|
| 8800942 | 2/1988 | PCT Int'l Appl. . |
| 8802042 | 3/1988 | PCT Int'l Appl. . |

*Primary Examiner*—A. Lionel Clingman

*Attorney, Agent, or Firm*—Kevin T. Mansfield; Edward McC. Roberts

[57] ABSTRACT

A process for preventing yellowing of polyamide fibre materials treated with stain-blocking agents which comprises treating the polyamide fibre material with a water-soluble light stabilizer with affinity for the fibre before, during or after the treatment with a stain-blocking agent, and the fibre material thus treated are described.

17 Claims, No Drawings

PROCESS FOR PREVENTING YELLOWING OF POLYAMIDE FIBRE MATERIALS TREATED WITH STAIN-BLOCKING AGENTS BY TREATMENT WITH WATER-SOLUBLE LIGHT STABILIZER HAVING FIBRE AFFINITY

The present invention relates to a process for preventing yellowing of polyamide fibre materials treated with stain-blocking agents.

The process comprises treating the polyamide fibre material with a water-soluble light stabilizer with affinity for the fibre before, during or after the treatment with a stain repellant.

The water-soluble light stabilizers with affinity for the fibre which are used according to the invention are benzotriazoles, pyrimidines and s-triazines which are substituted by 2-hydroxyphenyl and contain at least one sulfo group in the free form or in salt form, for example as the alkali metal, alkaline earth metal, ammonium or amine salt.

Preferred light stabilizers are those of the formula

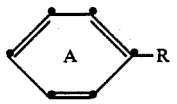

(I)

in which R is a radical of the formula

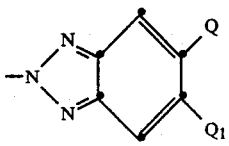

(II)

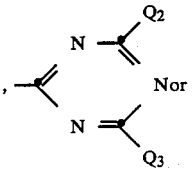

(III)

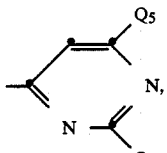

(IV)

in which Q is hydrogen or halogen, Q: is hydrogen, halogen, $C_1$–$C_4$ alkyl, $C_1$–$C_{14}$ alkoxy, $C_2$–$C_9$ alkoxycarbonyl, carboxyl or sulfo, $Q_2$ and $Q_3$ independently of one another are $C_1$–$C_4$ alkyl, $C_1$–$C_4$ alkoxy, $C_5$–$C_6$ cycloalkyl, phenyl or phenyl which is substituted by $C_1$–$C_4$ alkyl, $C_1$–$C_4$ alkoxy, $C_5$–$C_6$ alkanoyloxy, $C_1$–$C_4$ alkylcarbamoyloxy or hydroxy, $Q_4$ is phenyl or phenyl which is substituted by $C_1$–$C_4$ alkyl, $C_1$ –$C_4$ alkoxy, sulfo, halogen or hydroxy and $Q_5$ is $C_1$–$C_4$ alkyl, phenyl or phenyl which is substituted by $C_1$–$C_4$ alkyl, $C_1$–$C_4$ alkoxy, halogen or hydroxy, and the benzene ring A corresponds to the following radicals

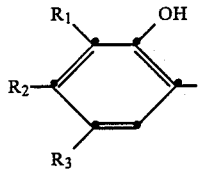

(V)

in which $R_1$ is hydrogen, $C_1$–$C_4$ alkyl, chlorine, $C_5$–$C_6$ cycloalkyl, $C_7$–$C_9$-phenylalkyl, sulfo or sulfo-$C_7C_9$ phenylalkyl, $R_2$ is hydrogen, hydroxyl, $C_1$–$C_4$ alkyl, $C_1$–$C_4$ alkoxy, chlorine or sulfo and $R_3$ is $C_1$–$C_4$ alkyl, $C_2$–$C_9$–alkoxy, hydroxy, phenyl, ($C_1$–$C_8$ alkyl)–phenyl, $C_5$-$C_6$ cycloalkyl, $C_2$–$C_9$–alkoxycarbonyl, chlorine, carboxyethyl, $C_7$–$C_9$ sphenylalkyl, sulfo or sulfo–C-$_7$–$C_9$ phenylalkyl, if R is a radical of the formula (II);

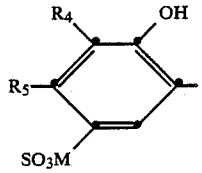

(VI)

in which $R_4$ is hydrogen, halogen, $C_1$–$C_4$ alkyl or sulfo, $R_5$ is hydrogen, $C_1$–$C_4$ alkyl, $C_1$–$C_5$ alkoxy, $C_1$–$C_4$ alkanoyloxy, $C_1$–$C_4$ alkylcarbamoyloxy or hydroxy and M is hydrogen or an alkali metal, if R is a radical of the formula (III), and

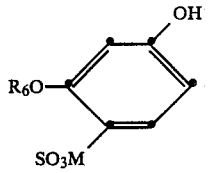

(VII)

in which $R_6$ is $C_1$–$C_4$ alkyl and M is hydrogen or an alkali metal, if R is a radical of the formula (IV).

Halogen in connection with all the substituents is, for example, bromine, fluorine, iodine ©r, preferably, chlorine.

$C_1$–$C_4$ substituents are, for example, methyl, ethyl, n-propyl, isopropyl, n-butyl, isobutyl, sec-butyl or tert-butyl.

$C_1$–$C_4$ Alkoxy substituents are, for example, methoxy, ethoxy, n-propoxy, isopropoxy, n-butoxy, isobutoxy, sec-butoxy or tert-butoxy.

$C_2$–$C_9$ Alkoxycarbonyl is, for example, methoxy-, ethoxy-, n-propoxy-, n-butoxy-, pentyloxy-, hexyloxy- or octyloxycarbonyl.

$C_5$–$C_6$ Cycloalkyl is, for example, cyclopentyl or cyclohexyl.

$C_7$–$C_9$ Phenylalkyl substituents are, for example, phenethyl or phenpropyl.

($C_1$–$C_4$ Alkyl)-phenyl substituents are, for example, tolyl, xylyl, p-n-propylphenyl or p-tert-butylphenyl.

$C_2$–$C_5$ salkanoyloxy is, for example, acetyloxy, propionyloxy, butyryloxy or valeryloxy.

$C_1$–$C_4$ Alkylcarbamoyloxy is, for example, N-methylcarbamoyloxy, N-ethylcarbamoyloxy, N-propylcarbamoyloxy or N-butylcarbamoyloxy.

Carboxyl and sulfo groups can be present in the free form or in salt form, for example as the alkali metal, alkaline earth metal, ammonium or amine salt, preferably as the sodium salt.

Water-soluble light stabilizers which have an affinity for fibres and are of practical interest are those of the formulae

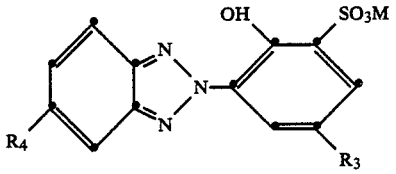

(VIII)

in which M is hydrogen or an alkali metal, $R_3$ is hydrogen, methyl or hydroxy and $R_4$ is hydrogen or halogen;

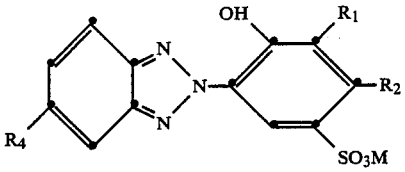

(IX)

in which M is hydrogen or an alkali metal, $R_1$ is hydrogen or $C_1$–$C_4$ alkyl, $R_2$ is hydrogen, hydroxy or $C_1$–$C_4$ alkoxy and $R_4$ is hydrogen or halogen;

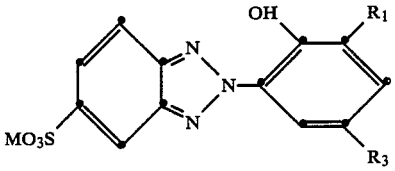

(X)

in which M is hydrogen or an alkali metal, $R_1$ is $C_1$–$C_4$ alkyl and $R_3$ is hydrogen or $C_1$–$C_4$ alkyl;

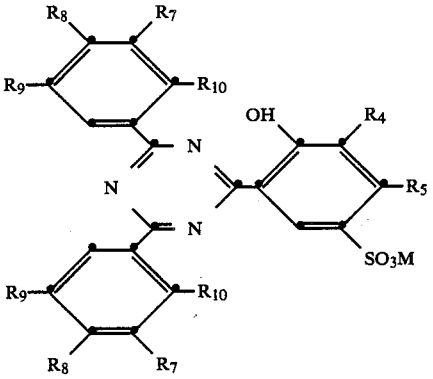

(XI)

in which M is hydrogen or an alkali metal, $R_4$ is hydrogen, $C_1$–$C_4$ alkyl or sulfo, $R_5$ is hydrogen, hydroxy, $C_1$–$C_4$ alkyl, $C_1$–$C_4$ alkoxy, $C_2$–$C_5$ alkanoyloxy or N-$C_1$–$C_4$ alkylcarbamoyloxy, $R_7$ and $R_9$ independently of one another are hydrogen, $C_1$–$C_4$ alkyl or sulfo, $R_8$ is hydrogen, hydroxy, $C_1$–$C_4$ alkyl, $C_1$–$C_4$ alkoxy or $C_2$–$C_5$ salkanoyloxy and $R_{10}$ is hydrogen, $C_1$–$C_4$ alkyl or hydroxy, and

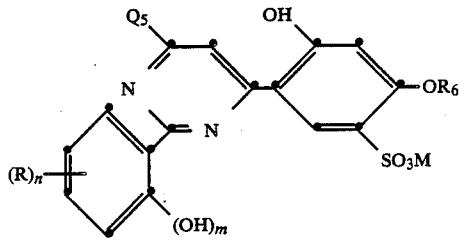

(XII)

in which R is $C_1$–$C_4$ alkyl, $C_1$–$C_4$ alkoxy, halogen or hydroxy, $R_6$ is $C_1$–$C_4$-alkyl, M is hydrogen or an alkali metal, m is 0 or 1, n is 0, 1 or 2 and $Q_5$ is $C_1$–$C_4$alkyl, phenyl or phenyl which is substituted by $C_1$–$C_4$ alkyl, $C_1$–$C_4$ alkoxy, halogen or hydroxy.

Water-soluble light stabilizers which have an affinity for fibres and are of special interest are those of the formulae

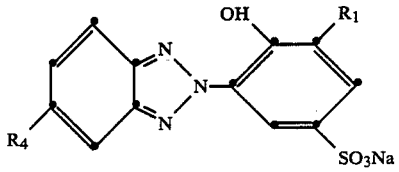

(XIII)

in which $R_1$ is —C—$(CH_3)_3$ or —$CH(CH_3)C_2H_5$ and $R_4$ is hydrogen or chlorine,

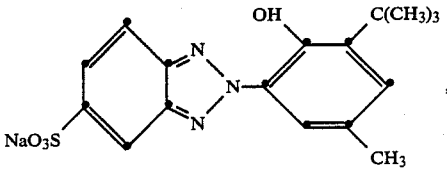

(XIV)

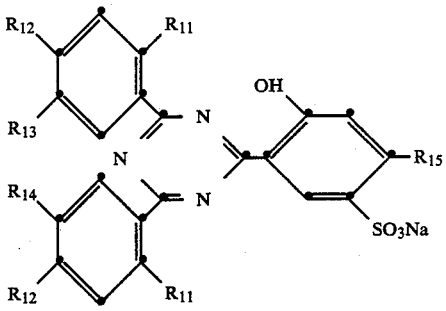

(XV)

in which $R_{11}$ and $R_{12}$ independently of one another are hydrogen or methyl, $R_{13}$ and $R_{14}$ independently of one another are hydrogen or sulfo and $R_{15}$ is $C_1$–$C_4$ alkoxy, and

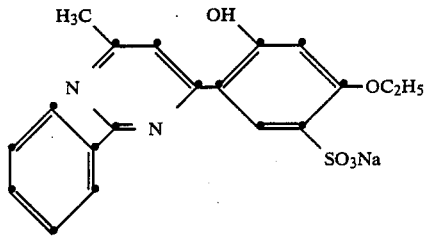

(XVI)

The light stabilizers of the formulae (I) or (XVI) to be used according to the invention are known in some cases. The novel compounds can be prepared by processes which are known per se. The compounds of the formula (I) in which R is the radical (II) and the benzene ring A is the radical (V) and those of the formulae (VIII)–(X), (XIII) and (XIV) can be prepared, for example, by the processes described in U.S. Pat. No. 3,403,183 or U.S. Pat. No. 4,127,586.

The compounds of the formula (I) in which R is the radical (III) and the benzene ring A is the radical (VI), and those of the formula (X) and (XV) can be prepared, for example, by the processes described in Helv. 55, 1566–1595 (1972).

Compounds of the formula (I) in which R is the radical (IV) and the benzene ring A is the radical (VII), and those of the formulae (XII) and (XVI) can be prepared by reacting one mol of 4,6-dichloro-2-phenylpyrimidine with one mol of resorcinol in the presence of a Friedel-Crafts catalyst and alkylating the resulting monochlorinated product by methods which are known per se.

The light stabilizers of the formulae (I) to (XVI) are advantageously applied from an aqueous bath, this advantageously being employed in an amount of 0.05 to 7.5, preferably 0.1 to 3 and in particular 0.1 to 2.0 % of the weight of the polyamide fibre material.

The light stabilizers of the formulae (I) to (XVI) can be applied separately from the stain-blocking agents or, preferably, at the same time as the stain-blocking agents by an exhaustion process, for example a winch vat. However, they can also be applied continuously by means of a low application system or a hot application system, for example with the Fluidyer® (Kusters), Flexuip® (Kusters) and the like.

Other light stabilizers which can be used are 2-hydroxybenzophenones of the formula

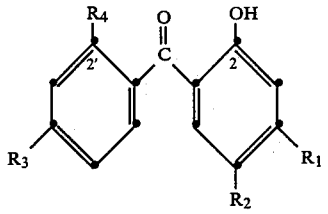

in which $R_1$ is hydrogen hydroxy, $C_1$–$C_{14}$ alkoxy or phenoxy, $R_2$ is hydrogen, halogen, $C_1$–$C_4$ alkyl or sulfo, $R_3$ is hydrogen, hydroxy or $C_1$–$C_4$ alkoxy and $R_4$ is hydrogen, hydroxy or carboxyl, for example the 4-hydroxy, 4-methoxy, 4-octyloxy, 4-decyloxy, 4-dodecyloxy, 4-methoxy-2'-carboxyl, 4,2',4'-trihydroxy, 4,4'-dimethoxy-2'-hydroxy, 4-methoxy-5-sulfo, 2'-hydroxy-4,4'-dimethoxy-5-sulfo, 4-benzyloxy or 5-chloro derivative.

Simultaneous application of the light stabilizer and stain-blocking agent can take place during or preferably after dyeing of the polyamide fibre material. The liquor used has a pH of 2–8, preferably 3–6 and in particular 3.5–5.

Polyamide material is understood as meaning synthetic polyamide, for example polyamide-6, polyamide-6,6 or polyamide-12. In addition to pure polyamide fibres, fibre blends of polyurethane and polyamide in particular are also suitable, thus, for example, tricot material of polyamide/polyurethane in a blending ratio of 70:30. The pure or blended polyamide material can in principle be present in the most diverse processing forms, for example as fibre, yarn, woven fabric, knitted fabric or pile material.

Polyamide material in particular which is exposed to light and light/heat and is in the form of, for example, carpets or car upholstery is especially suitable for treatment by the present process.

Suitable stain-blocking agents are, for example, polymeric condensation products consisting essentially of recurring units of the formula

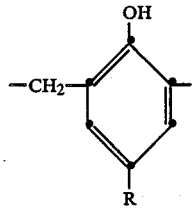

in which R is identical or different in each unit and is hydrogen or a radical chosen from

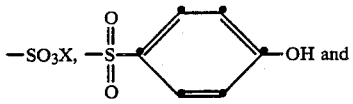

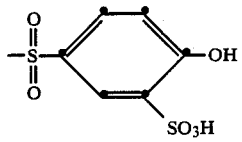

in which X is hydrogen or a cation, such as $NH_3$, Na or K. Such agents are, for example, condensation products of phenolsulfonic acid and dihydroxydiphenyl sulfone with formaldehyde or condensation products of naphthalenesulfonic acid and dihydroxydiphenyl sulfone with formaldehyde and condensation products of formaldehyde and sulfonated naphthol, phenol or cresol (compare, for example U.S. Pat. No. 4,680,212, EP-A-0,242,495 or EP-0,235,989). These products are also in use as reserve agents, agents for improving wet-fastness and the like. Other agents are to be found, for example, in A. Chwala and V. Anger "Handbuch der Textilhilfsmittel" (Handbook of Textile Auxiliaries), 618 Verlag Chemie, Weinheim, New York (1977).

The customary dyes which are suitable for the dyeing according to the invention are, for example, direct dyes, acid dyes, metal complex dyes, disperse dyes, vat dyes and basic dyes. Anionic dyes are preferred. These dyes are, for example, salts of mono-, di- or polyazo dyes containing heavy metals or, preferably, free from metals, including the formazan dyes, as well as the anthraquinone, xanthene, nitro, triphenylmethane, naphthoquinoneimine and phthalocyanine dyes. The anionic character of these dyes can result from the metal complexing alone and/or preferably from acid salt-forming substituents, such as carboxylic acid groups, sulfuric acid and phosphonic acid ester groups, phosphonic acid groups or sulfonic acid groups. These dyes can also contain in the molecule so-called reactive groupings which undergo covalent bonding with the fibre to be dyed. The so-called acid metal-free dyes are preferred.

The latter preferably contain only a single sulfonic acid group.

The 1:1 or 1:2 metal complex dyes are also of interest. The 1:1 metal complex dyes preferably contain one or two sulfonic acid groups. They contain a heavy metal atom, for example copper, nickel or, in particular, chromium, as the metal. 1:2 Cobalt or 1:2 chromium complexes of monoazo dyes containing an acid amide or alkylsulfonyl group or a single sulfonic acid group in total are preferred.

Mixtures of at least two or three dyes can also be used according to the invention, in which case level, deep mixed-shade dyeings, including a two- or three-coloured dyeing, can be produced. Three-colour is understood, in particular as a three-component combination of the basic colours yellow (or orange), red and blue.

Examples of dyes which can be used are also described in Colour Index, 3rd edition, 1971, Volume 4.

The dye liquors used can also contain all the chemicals suitable for use in the polyamide textile industry, for example levelling or migration auxiliaries.

The abovementioned stain-blocking agents can be applied before, during and in particular after dyeing of the polyamide fibre material.

The following examples illustrate the invention. Parts are parts by weight and percentages are percentages by weight.

Preparation Example 16.5 g of 2-(2'-hydroxy-4'-methoxyphenyl)-4,6-bis-(2',4'-dimethyl- phenyl)-1,3,5-triazine are introduced into 150 ml of sulfuric acid monohydrate at 20° C. and the mixture is stirred at 20° C. for 30 minutes. It is then heated to 80–85° C. and stirred at this temperature for 3 hours and then at 90° C. for a further hour in order to bring the reaction to completion. After cooling to 20° C., the contents of the flask are stirred into a solution of 60 g of sodium chloride in 600 ml of water, whereupon the temperature rises to 85° C. The mixture is stirred at this temperature for a further 30 minutes and then cooled to 20° C. and filtered. The filter cake is suspended in 300 ml of water and the pH is brought to 7 with 30 % sodium hydroxide solution. The product is filtered off and washed once with 5 % sodium chloride solution. After drying at 100° C. in vacuo, 23 g of a product of the formula

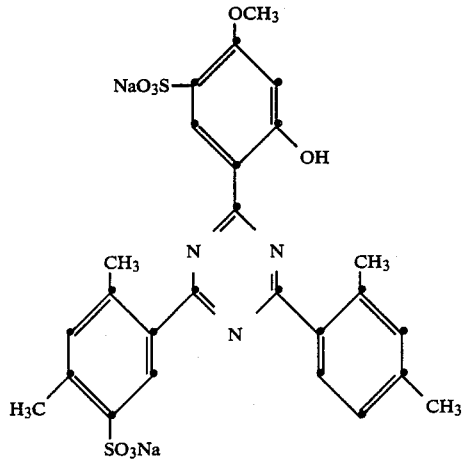

(100)

are obtained.

The product still contains small amounts of a trisulfonic acid product. The product can be recrystallized from a mixture of dimethylformamide and water in the ratio 7:3.

The compounds of the formulae

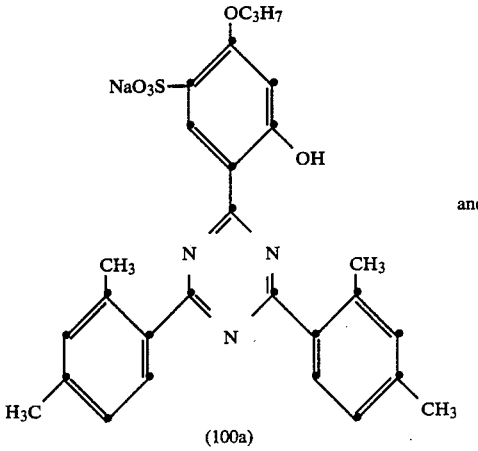

(100a)

and

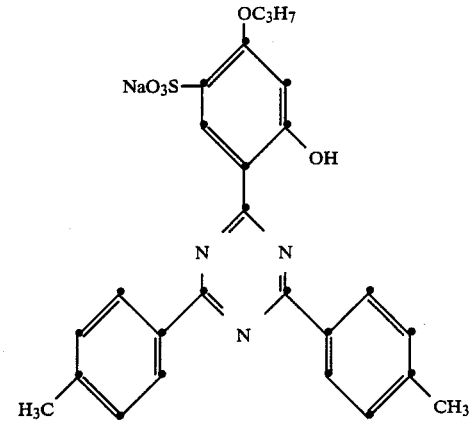

(100b)

are obtained in a similar manner when 2-(2'-hydroxy-4'-propoxyphenyl)-4,6-bis-(2', 4'dimethylphenyl)-1,3,5-triazine or 2-(2'-hydroxy-4'-propoxyphenyl)-4,6-bis-(4'-methylphenyl)-1,3,5-triazine is employed as the starting substance.

Use Examples:

Example 1:

Two non-dyed polyamide 66 pile carpet pieces with a polypropylene backing (640 g/m$^2$) of 25 g are treated at a liquor ratio of 1:25 in liquors of the following composition:

Liquor 1: 2 % of a condensation product of benzenesulfonic acid and dihydroxydiphenyl sulfone with formaldehyde 2% of 80% acetic acid (pH 5) 1% of Mg sulfate.7$H_2O$ Liquor 2: 2% of a condensation product of benzenesulfonic acid and dihydroxydiphenyl sulfone with formaldehyde 2% of 80% acetic acid (pH 5) 1% of Mg sulfate.7$H_2O$ 0.75% of the compound of the formula

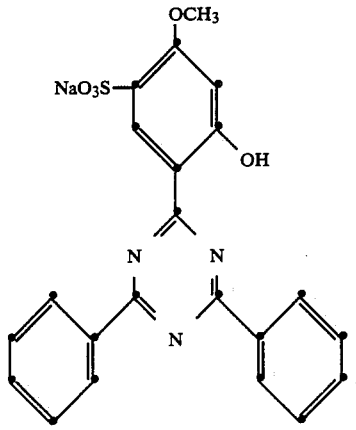

(101)

The two carpet samples a and b are treated in a laboratory dyeing apparatus, for example one of the types AHIBA, by introducing them at 40° C., heating the liquor at 75° C. with continuous agitation, and leaving the system at this temperature for 20 minutes. The samples are then rinsed thoroughly (cold), centrifuged and dried at 80° C.

The two pieces of carpet are irradiated, partly under cover, for 60 minutes in the UV light of a mercury discharge lamp, for example one from BBC with a power density of 2.5 W/cm$^2$ and a UV$_c$ source intensity of 2.9 $W_{uvc}$/cm$^2$. The sample treated with liquor 1 assumes a very distinct yellow shade during this exposure, whereas the sample treated with liquor 2 remains unchanged in the ground white.

A staining test is carried out with "Food Drug and Cosmetic (FD & C)" Red 40 to check the so-called "stain-blocking" effect. In this test, both samples exhibit an equivalent reserve effect. In contrast, the untreated carpet material is stained an intense red.

Staining test:

80 mg/1 of FD & C Red 40 and 0.5 g/l of citric acid are dissolved in water, a pH of 3 being established. The test specimens are shaken in a shaking apparatus at a liquor ratio of 1:20 at room temperature for 4 hours. They are then rinsed thoroughly in the cold, centrifuged and dried at 60° C. The degree of staining of the samples gives an indication of the quality of the reserve effect.

Examples 2–6:

The procedure is as described in Example 1, but the compounds of the formulae

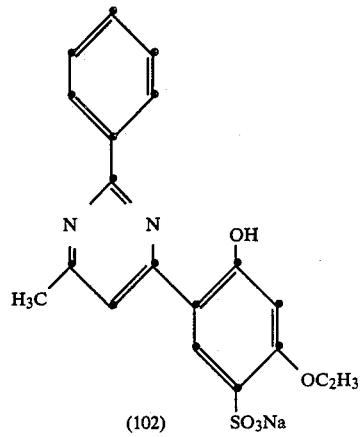

(102)

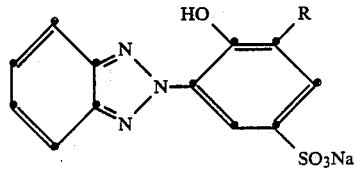

R = —C(CH$_3$)$_3$ (103)
—CH(CH$_3$)C$_2$H$_5$ (104)

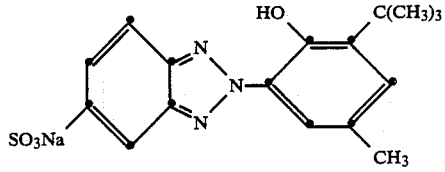

(105)

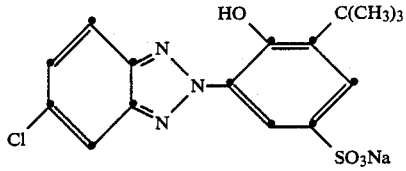

(106)

always in the same amount, are used as UV absorbers. A significantly reduced tendency of the treatment to yellow when exposed to the mercury lamp is also obtained on the carpet samples treated with these substances.

Example 7:

The procedure is as described in Example 1, with the difference that instead of the condensation product used therein, a condensation product of naphthalenesulfonic acid and dihydroxydiphenyl sulfone with formaldehyde is used. In this experiment also, a very good "stainblocking" effect is obtained with reduced yellowing when the UV absorber of the formula 101 is used.

Example 8:

Two PA 6 carpet samples (620 g/cm$^2$) 20×40 cm in size and dyed pale olive are impregnated with the following liquors on a padder:

Liquor 3: 1.00 g/l of condensation product of naphthalenesulfonic acid and dihydroxydiphenyl sulfone with formaldehyde 2.00 g/l of 80% acetic acid 1.00 g/l of ammonium sulfate Liquor 4: 1.00 g/l of condensation product of naphthalenesulfonicacid and dihydroxydiphenyl suflone with formaldehyde 2.00 g/l of 80% acetic acid 1.00 g/l of ammonium sulfate 0.50 g/l of the compound of the formula

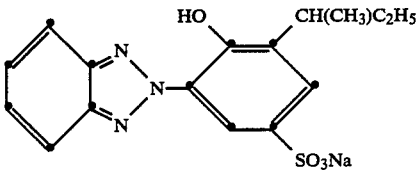

(104)

The sample strips are impregnated with a squeeze-off effect of 270% and then steamed with saturated steam for 5 minutes. They are then rinsed cold for a short time and dried at 100° C.

To check the effect of the UV absorber (compound of the formula 104), samples from the two treatments are exposed in an Atlas ES 25 ® Weather-O-meter to xenon radiation with a borosilicate/window glass filter system (no radiation in the range from 250 to 300 nm) for 20 hours. Here also, the carpet sample treated with liquor 3 shows a considerably higher tendency to yellow (detectable as a colour shift) than that treated with liquor 4.

Example 9:

Two non-dyed polyamide 6 pile carpet pieces with polypropylene backing (870 g/m$^2$) of in each case 20 g are treated in a bomb dyeing apparatus at a liquor ratio of 1:30 in liquors of the following composition:

Liquor 1: 2% of ammonium sulfate, 0.2 g/l of a wetting agent, for example the Na salt of dioctylsulfosuccinic acid, 2% of a levelling agent (for example ®Albegal SW) 0.035% of the dye C.I. Acid Black mix 0.002% of the dye C.I. Acid Red 251

Liquor 2: 2% of ammonium sulfate 0.2g/l of a wetting agent, for example the Na salt of dioctylsulfosuccinic acid, 2% of a levelling agent (for example ®Albegal SW) 0.035% of the dye C.I. Acid Black mix 0.002% of the dye C.I. Acid Red 251 0.5% of the compound of the formula (101)

The carpet samples are treated by first introducing them at 40° C. into the liquors containing only ammonium sulfate and textile auxiliaries and treating them for 10 minutes. The dissolved dyes are then added to both liquors and the compound (101) is additionally added to liquor 2. The temperature is now increased to 100° C. at the rate of 1.5° /minute, dyeing is carried out at this temperature for 45 minutes, and the samples are cooled, rinsed and centrifuged.

The still moist samples are treated separately in liquors (liquor ratio of 1:30) which contain 2% of a condensation product of benzenesulfonic acid and dihydroxydiphenyl sulfone with formaldehyde and 2% of Mg sulfate.7$H_2O$ and have been brought to pH 3 with sulfamic acid.

The treatment is carried out at 55° C. for 20 minutes. The samples are then rinsed, centrifuged and dried at 80° C.

The two samples are tested for their "stain-blocking" effect—as described in Example 1—and exposed to light in accordance with AATCC 16 E with a xenon lamp for 20 hours. Whereas the "stain-blocking" effect is equivalent on both samples, the sample dyed in liquor 1 exhibits distinct yellowing in comparison with that dyed in liquor 2.

Example 10:

The procedure is as described in Example 9, with the difference that the compounds (104) and (100) are used instead of compound (101). Testing of the carpet sample shows that the yellowing after exposure to light is also inhibited by the compounds (104) and (100).

Example 11:

The procedure is as described in Example 9, with the difference that the "stain-blocking" treatment is carried out with 2.7% of a condensation product of higher molecular weight aromatic sulfonic acids (for example ®Mesitol NBS)

Under this treatment also, the carpet sample containing the UV absorber does not yellow.

Example 12:

The procedure is as described in Example 9, with the difference that the "stain-blocking" treatment is carried out with 3.2% of a condensation product of naphthalenesulfonic acid, dihydroxydiphenyl sulfone and formaldehyde (for example ®Stainmaster NRD 311A)

Under this treatment also, the UV absorber inhibits yellowing of the carpet sample.

We claim:

1. A process for preventing yellowing of a polyamide fiber material treated with a stain-blocking agent, which comprises treating the polyamide fiber material with a water-soluble light stabilizer with affinity for the fiber which is of the formula

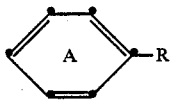

(I)

in which R is a radical of the formula

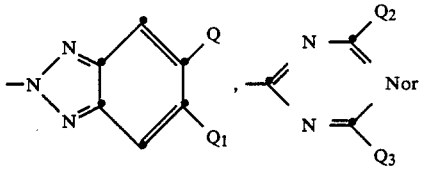

(II) (III)

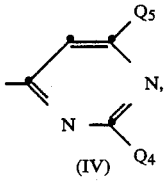

(IV)

in which Q is hydrogen or halogen, $Q_1$ is hydrogen, halogen, $C_1$–$C_4$ alkyl, $C_1$–$C_4$ alkoxy, $C_2$–$C_9$ alkoxycarbonyl, carboxyl or sulfo, $Q_2$ and $Q_3$ independently of one another are $C_3$–$C_4$ alkyl, $C_1$–$C_4$ alkoxy, $C_5$–$C_6$ cycloalkyl, phenyl or phenyl which is substituted by $C_1$–$C_4$ alkyl, $C_1$–$C_4$ alkoxy, $C_2$–$C_5$ alkanoyloxy, $C_1$–$C_4$ alkylcarbamoyloxy or hydroxy, $Q_4$ is phenyl or phenyl which is substituted by $C_1$–$C_4$ alkyl, $C_1$–$C_4$ alkoxy, sulfo, halogen or hydroxy and $Q_5$ is $C_1$–$C_4$ alkyl, phenyl or phenyl which is substituted by $C_1$–$C_4$ alkyl, $C_1$–$C_4$ alkoxy, halogen or hydroxy, and the benzen ring A corresponds to the following radicals

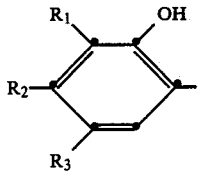
(V)

in which $R_1$ is hydrogen, $C_1$–$C_4$ alkyl, chlorine, $C_5$–$C_6$ cycloalkyl, $C_7$–$C_9$-phenylalkyl, sulfo or sulfo-$C_7$–$C_9$ phenylalkyl, $R_2$ is hydrogen, hydroxyl, $C_1$–$C_4$ alkyl, $C_1$–$C_4$ alkoxy, chlorine or sulfo and $R_3$ is $C_1$–$C_4$ alkyl, $C_3$–$C_4$-alkoxy, hydroxy, phenyl, ($C_1$–$C_8$ alkyl)-phenyl, $C_5$–$C_6$ cycloalkyl, $C_2$–$C_9$-alkoxycarbonyl, chlorine, carboxyethyl, $C_7$–$C_9$ phenylalkyl, sulfo or sulfo-$C_7$–$C_9$ phenylalkyl, if R is a radical of the formula (II);

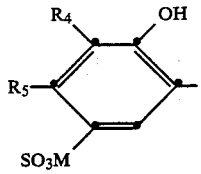
(VI)

in which $R_4$ is hydrogen, halogen, $C_1$–$C_4$ alkyl or sulfo, $R_5$ is hydrogen, $C_1$–$C_4$ alkyl, $C_1$–$C_4$ alkoxy, $C_2$–$C_5$ alkanoyloxy, $C_1$–$C_4$ alkylcarbomoyloxy or hydroxy and M is hydrogen or an alkali metal, if R is radical of the formula (III), and

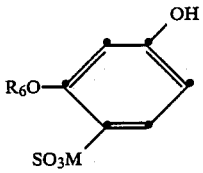
(VII)

in which $R_6$ is $C_1$–$C_4$ alkyl and M is hydrogen or an alkali metal, if R is a radical of the formula (IV), before, during or after the treatment with a stain-blocking agent.

2. The process according to claim 1, wherein a compound of the formula

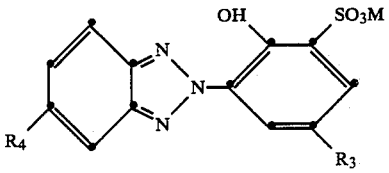
(VIII)

in which M is hydrogen or an alkali metal, $R_3$ is hydrogen, methyl or hydroxy and $R_4$ is hydrogen or halogen, is used as the water-soluble light stabilizer with affinity for the fiber.

3. The process according to claim 1, wherein a compound of the formula

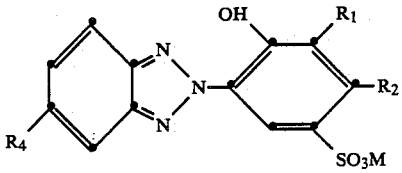
(IX)

in which M is hydrogen or an alkali metal, $R_1$ is hydrogen or $C_1$–$C_4$ alkyl, $R_2$ is hydrogen, hydroxy or $C_1$–$C_4$ alkoxy and $R_4$ is hydrogen or halogen, is used as the water-soluble light stabilizer with affinity for the fibre.

4. The process according to claim 1, wherein a compound of the formula

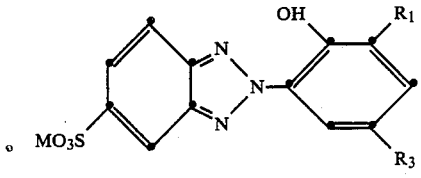
(X)

in which M is hydrogen or an alkali metal, $R_1$ is $C_1$–$C_4$ alkyl and $R_3$ is hydrogen or $C_1$–$C_4$ alkyl, is used as the water-soluble light stabilizer with affinity for the fibre.

5. The process according to claim 1, wherein a compound of the formula

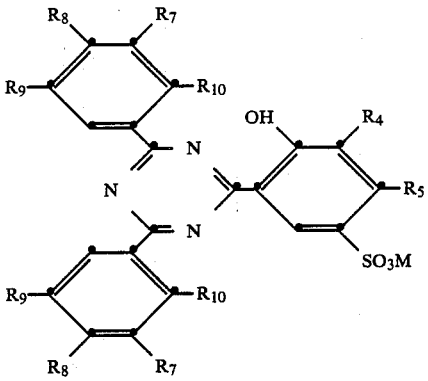
(XI)

in which M is hydrogen or an alkali metal, $R_4$ is hydrogen, $C_1$–$C_4$ alkyl or sulfo, $R_5$ is hydrogen, hydroxy, $C_1$–$C_4$ alkyl, $C_1$–$C_4$ alkoxy, $C_2$–$C_5$ alkanoyloxy or N-$C_1$–$C_4$ alkylcarbamoyloxy, $R_7$ and $R_9$ independently of one another are hydrogen, $C_1$–$C_4$ alkyl or sulfo, $R_8$ is hydrogen, hydroxy, $C_1$–$C_4$ alkyl, $C_1$–$C_4$ alkoxy or $C_2$–$C_5$ alkanoyloxy and $R_{10}$ is hydrogen, $C_1$–$C_4$ alkyl or hydroxy, is used as the water-soluble light stabilizer with affinity for the fibre.

6. The process according to claim 1, wherein a compound of the formula

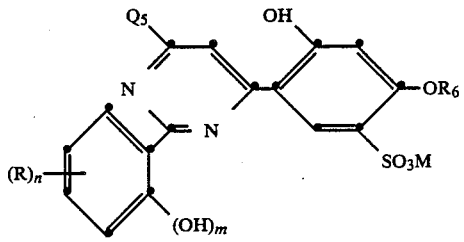

(XII)

in which R is $C_1$–$C_4$ alkyl, $C_1$–$C_4$ alkoxy, halogen or hydroxy, $R_6$ is $C_1$–$C_4$-alkyl, M is hydrogen or an alkali metal, m is 0 or 1, n is 0, 1 or 2 and $Q_5$ is $C_1$–$C_4$ alkyl, phenyl or phenyl which is substituted by $C_1$–$C_4$ alkyl, $C_1$–$C_4$ alkoxy, halogen or hydroxy, is used as the water-soluble light stabilizer with affinity for the fibre.

7. The process according to claim 3, wherein a compound of the formula

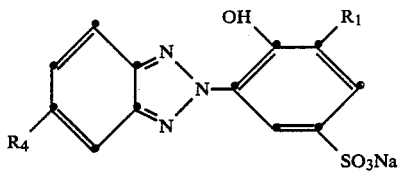

(XIII)

in which $R_1$ —C—$(CH_3)_3$ or —$CH(CH_3)C_2H_5$ and $R_4$ is hydrogen, is used as the water-soluble light stabilizer with affinity for the fibre.

8. The process according to claim 4, wherein a compound of the formula

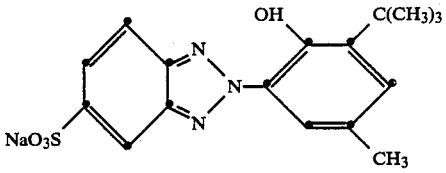

(XIV)

is used as the water-soluble light stabilizer with affinity for the fibre.

9. The process according to claim 5, wherein a compound of the formula

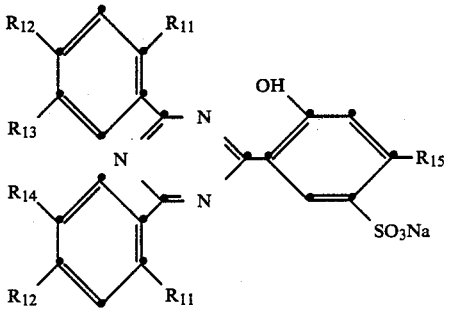

(XV)

in which $R_{11}$ and $R_{12}$ independently of one another are hydrogen or methyl, $R_{13}$ and $R_{14}$ independently of one another are hydrogen or sulfo and $R_{15}$ is $C_1$–$C_4$ alkoxy, is used as the water-soluble light stabilizer with affinity for the fibre.

10. The process according to claim 6, wherein a compound of the formula

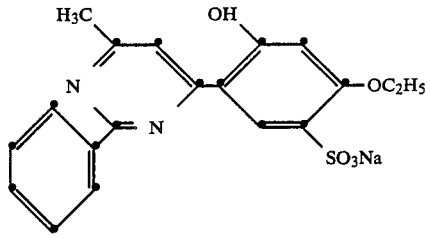

(XVI)

is used as the water-soluble light stabilizer with affinity for the fibre.

11. The process according to claim 2, wherein the treatment of the polyamide fibre material with the light stabilizer is carried out continuously by a padding process.

12. The process according to claim 2, wherein the treatment of the polyamide fibre material with the light stabilizer is carried out discontinuously by an exhaustion process.

13. The process according to claim 11, wherein the treatment is carried out during dyeing.

14. The process according to claim 12, wherein the treatment is carried out during dyeing.

15. The process according to claim 11, wherein the treatment is carried out after dyeing.

16. The process according to claim 12, wherein the treatment is carried out after dyeing.

17. The polyamide fibre material treated in accordance with the process of claim 2.

* * * * *